US012584303B2

(12) United States Patent
Sargand et al.

(10) Patent No.: US 12,584,303 B2
(45) Date of Patent: Mar. 24, 2026

(54) STRESS-REDUCING PROFILE FOR MODULAR STORM DRAINAGE MANAGEMENT SYSTEMS

(71) Applicant: Ohio University, Athens, OH (US)

(72) Inventors: Shad M. Sargand, Delaware, OH (US); Issam Khoury, Athens, OH (US)

(73) Assignee: Ohio University, Athens, OH (US)

( * ) Notice: Subject to any disclaimer, the term of this patent is extended or adjusted under 35 U.S.C. 154(b) by 123 days.

(21) Appl. No.: 18/834,367

(22) PCT Filed: Feb. 3, 2023

(86) PCT No.: PCT/US2023/012262

§ 371 (c)(1),
(2) Date: Jul. 30, 2024

(87) PCT Pub. No.: WO2023/150257

PCT Pub. Date: Aug. 10, 2023

(65) Prior Publication Data

US 2025/0122712 A1 Apr. 17, 2025

Related U.S. Application Data

(60) Provisional application No. 63/373,905, filed on Aug. 30, 2022, provisional application No. 63/267,489, filed on Feb. 3, 2022.

(51) Int. Cl.
*E03F 1/00* (2006.01)

(52) U.S. Cl.
CPC ..... *E03F 1/005* (2013.01)

(58) Field of Classification Search
CPC ..... E03F 1/005
See application file for complete search history.

(56) References Cited

U.S. PATENT DOCUMENTS

2013/0152499 A1 6/2013 Kriekemeier
2015/0260313 A1* 9/2015 Miskovich ..... B23P 19/00 405/157
2021/0148105 A1 5/2021 Zarraonandia

FOREIGN PATENT DOCUMENTS

CN 104790463 A 7/2015
DE 60037329 T2 * 11/2008 ..... E02B 11/005
EP 0943737 B1 6/2003

OTHER PUBLICATIONS

International Searching Authority, International Search Report and Written Opinion issued in corresponding PCT Application No. PCT/US2023/012262, dated Jun. 5, 2023.

* cited by examiner

*Primary Examiner* — Kyle Armstrong
(74) *Attorney, Agent, or Firm* — Wood Herron & Evans LLP

(57) ABSTRACT

A drainage management apparatus for collecting and storing stormwater for controlled discharge is provided. The drainage management apparatus includes an upper and a lower slab. The upper slab is spaced a distance from the lower slab. The drainage management apparatus also includes at least one vertical assembly. The at least one vertical assembly includes a column located between the upper and the lower slab and spans the distance separating the upper and the lower slab. The vertical assembly also includes a dome located atop the column such that the dome is supported by the column. The dome protrudes from the upper slab and is configured to carry a load. The drainage management apparatus further includes a plurality of side panels. The plurality of side panels surround the upper slab, the lower slab, and the at least one vertical assembly to form a chamber. The chamber is configured to store stormwater.

20 Claims, 5 Drawing Sheets

STRESS-REDUCING PROFILE FOR MODULAR STORM DRAINAGE MANAGEMENT SYSTEMS

RELATED APPLICATION

This application claims the benefit of the filing date of U.S. Patent Application Ser. No. 63/267,489, filed Feb. 3, 2022, the disclosure of which is incorporated by reference herein in its entirety. This application also claims the benefit of the filing date of U.S. Patent Application Ser. No. 63/373,905, filed Aug. 30, 2022, the disclosure of which is incorporated by reference herein in its entirety.

TECHNICAL FIELD

This application relates generally to systems to collect and store stormwater, and, more particularly, to a stress-reducing profile for drainage management systems.

BACKGROUND

This section is intended to introduce the reader to various aspects of art that may be related to various aspects of the present invention, which are described and/or claimed below. This discussion is believed to be helpful in providing the reader with background information to facilitate a better understanding of various aspects of the present invention. Accordingly, it should be understood that these statements are to be read in this light, and not as admissions of prior art.

Various vendors have devised storm drainage management systems to collect and store stormwater for controlled discharge into a storm sewer system. The top slabs of these systems transfer the load of the weight of the soil above the system to the columns of the system. Current designs use a flat plastic slab which can be bent and deformed under the weight of soil. The current design geometry puts the slab in significant tension which, in the long term, has potential for cracking and thus significantly reducing the service life expectancy of the system. These slabs also have a compression zone where the slabs are made of thin, vertical elements. This configuration can be unstable and is vulnerable to local buckling. Furthermore, in some cases, a column could punch through the slab, causing it to experience shear failure.

Accordingly, it would be desirable to provide a drainage management system that avoids, alleviates, or otherwise minimizes the drawbacks or shortcomings of existing drainage management systems.

SUMMARY

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be explicitly set forth below.

In a first set of embodiments of the invention, a drainage management apparatus for collecting and storing stormwater for controlled discharge is provided. The drainage management apparatus includes an upper slab and a lower slab. The upper slab is spaced a distance from the lower slab. The drainage management apparatus also includes at least one vertical assembly. The at least one vertical assembly includes a column located between the upper slab and the lower slab and spans the distance separating the upper slab and the lower slab. The at least one vertical assembly also includes a dome located atop the column such that the dome is supported by the column. The dome protrudes from the upper slab and is configured to carry a load. The drainage management apparatus further includes a plurality of side panels. The plurality of side panels surround the upper slab, the lower slab, and the at least one vertical assembly to form a chamber. The chamber is configured to store stormwater.

In one embodiment the column may include a tapered cone portion. The tapered cone portion tapering at an angle between a first diameter and a second diameter. The first diameter and the second diameter located at opposing ends of the tapered cone portion. Additionally, the first diameter of the tapered cone portion may be approximately equivalent to a diameter of the dome and the second diameter of the tapered cone portion may be less than a diameter of the dome. Further, the tapered cone portion may be arranged such that the first diameter of the tapered cone portion is located adjacent to the dome.

In another embodiment, the column and the dome of the at least one vertical assembly may be of hollow construction. Alternatively, the column and the dome of the at least one vertical assembly may be of solid construction. Further, the column and the dome of the at least one vertical assembly may be of integral construction.

In yet another embodiment, the at least one vertical assembly may include a plurality of vertical assemblies and the plurality of vertical assemblies may be arranged in a grid-like pattern relative to the upper slab and the lower slab. Further, the lower slab may provide lateral support to the column and may provide resistance to lateral pressure on the plurality of side panels.

In one embodiment the dome may be configured to utilize soil-structure interactions to reduce the load on the upper slab from a soil located on top of the drain management apparatus. Further, the load may be transferred from the dome to the column. Additionally, the dome may carry at least 50% of the load from a soil located on top of the drain management apparatus. Even further, the dome may carry at least 60% of the load from the soil located on top of the drain management apparatus. Furthermore, the dome may carry at least 70% of the load from the soil located on top of the drain management apparatus.

In another embodiment, the chamber may be wrapped in a cover. Further, the cover may be a nonwoven geotextile fabric. Additionally, the chamber may include at least one inlet pipe and at least one outlet pipe.

In yet another embodiment, the drain management apparatus may be made of thermoplastic materials. Particularly, the thermoplastic materials may be selected from the group consisting of polyvinyl chloride (PVC) and polyethylene (PE).

In another set of embodiments of the invention, a drainage management system for collecting and storing stormwater for controlled discharge is provided. The drainage management system includes a plurality of drainage management apparatuses. The plurality of drainage management apparatuses are arranged to cover a desired area.

BRIEF DESCRIPTION OF THE DRAWINGS

The accompanying drawings, which are incorporated in and constitute a part of this specification, illustrate embodiments of the present invention and, together with the Detailed Description given below, serve to explain the present invention.

DETAILED DESCRIPTION OF THE INVENTION

Figure 1:
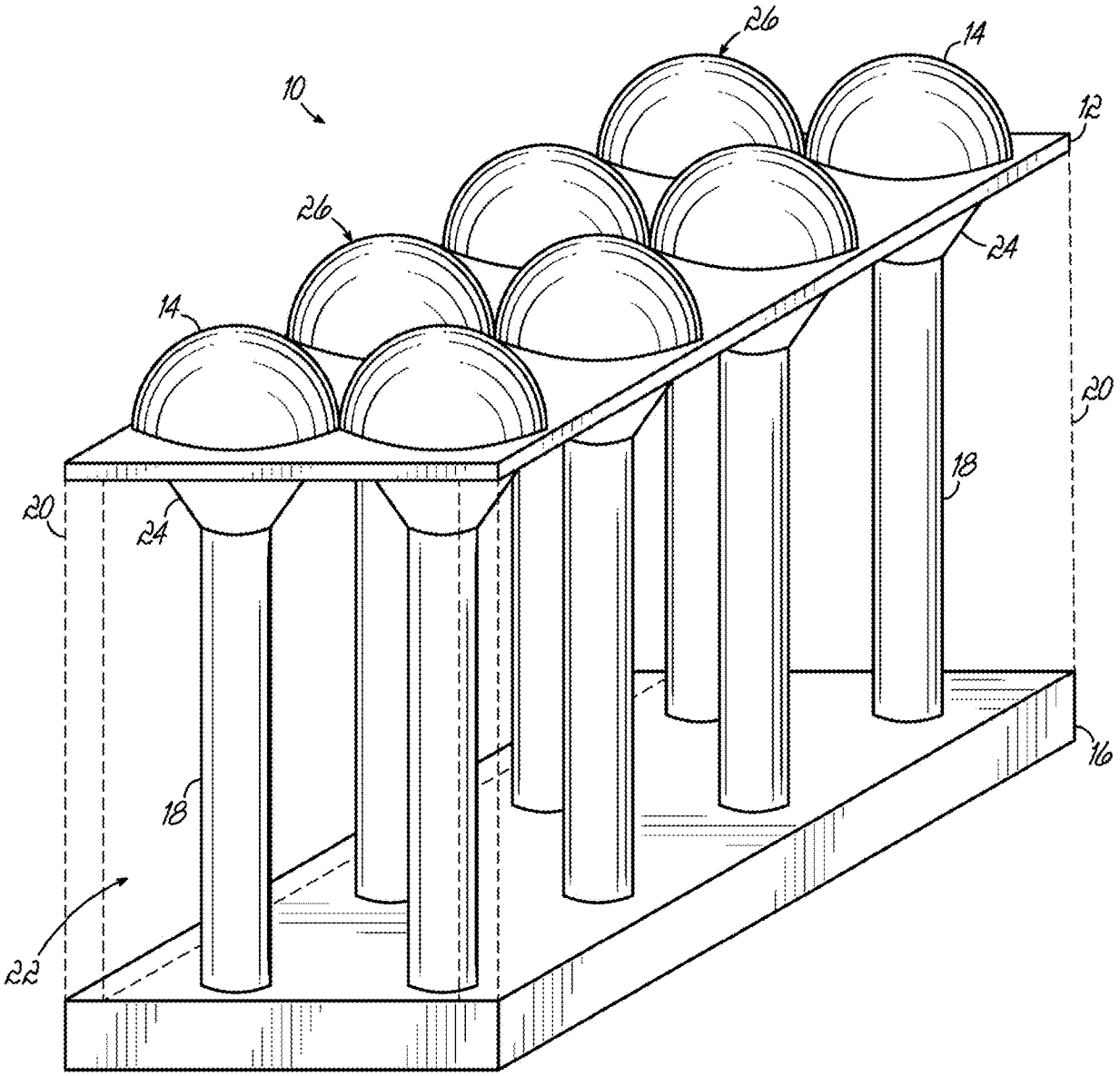
FIG. 1 is a perspective view of an embodiment of a drainage management apparatus according to principles of the present invention.

The exemplary embodiments described herein are provided for illustrative purposes and are not limiting. Other exemplary embodiments are possible, and modifications may be made to the exemplary embodiments within the scope of the present disclosure. Therefore, this Detailed Description is not meant to limit the scope of the present disclosure.

As described above, there presently are drawbacks or shortcomings of existing drainage management systems. In one aspect, the present invention avoids, alleviates, or otherwise minimizes these drawbacks or shortcomings and provides a drainage management apparatus 10 that can withstand greater loads.

Referring now to the Figures, embodiments of the drainage management apparatus 10, in accordance with principles of the invention, are depicted. In the depicted embodiments, the drainage management apparatus 10 includes a slab (specifically, an upper slab 12) containing domes 14. The inclusion of domes 14 helps to transfer the soil load from the upper slab 12 and thereby helps to prevent or minimize failure modes of the drainage management apparatus 10 (e.g., by cracking, local buckling, shear failure, or similar failure modes) and may extend the service life expectancy of the drainage management apparatus 10. Advantageously, the drainage management apparatus 10 of the present invention provides for an upper slab 12 that can withstand greater loads in the form of soil backfill (e.g., can withstand burial under a greater height of backfill) and is adaptable to a variety of applications. Further, a series of drain management apparatuses 10 can be laid out to cover a desired area (e.g., forming a drainage management system) and additional vertical layers can be added to the drain management apparatus 10 beyond those of the embodiments depicted in the Figures to expand the system. Other advantages and technical effects of the embodiments of this invention will become evident to one skilled in the art from the following description.

Beginning with reference to FIG. 1, the Figure shows an embodiment of a drainage management apparatus 10. The depicted drainage management apparatus 10 generally consists of slab 12, 16 and column 18 elements made of thermoplastic materials-polyvinyl chloride (PVC) or polyethylene (PE), for example. It is to be understood that other suitable materials could be used. Specifically, the drainage management apparatus 10 includes at least two slabs—an upper slab 12 at the top of the drainage management apparatus 10 and a lower slab 16 at the bottom of the drainage management apparatus 10.

Columns 18 for support are arranged between the two slabs 12, 16. The columns 18 may be tapered in shape, though the columns 18 need not be tapered. In the illustrated embodiment, the columns 18 may include a tapered cone portion 24. As depicted, the columns 18 may be arranged in two or more rows within the drainage management apparatus 10 (e.g., in a grid-like pattern relative to the slabs 12, 16). Each row may include several columns 18. It is to be understood that the columns 18 may be alternatively arranged within the drain management apparatus 10. Side panels 20 are placed around the outside of the structure formed by the slabs 12, 16 and columns 18 to create an interior chamber 22 for storing stormwater, for example. The chamber 22 may then be wrapped with a cover (not shown). The cover may be a nonwoven geotextile fabric or similar material. Inlet and outlet pipes (not shown) can be attached to the chamber 22 of the drainage management apparatus 10 where needed or desired (e.g., in one or more of the side panels 20) to aid in the collection and discharge of the collected stormwater. The assembled drainage management apparatus 10 can then be buried in backfill soil, for example.

Figure 2:
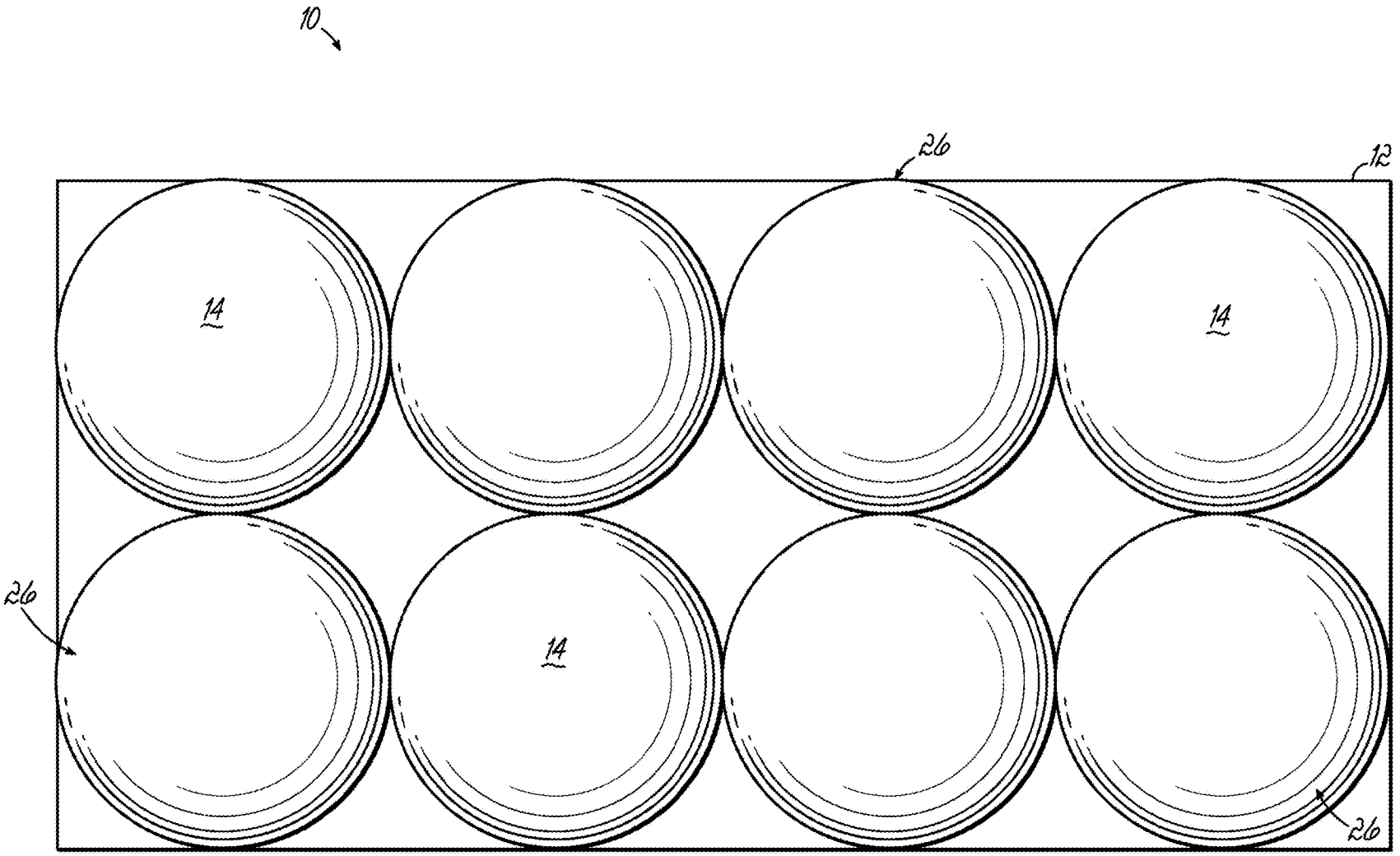
FIG. 2 is a top view of the drainage management apparatus of FIG. 1.
Figure 3:
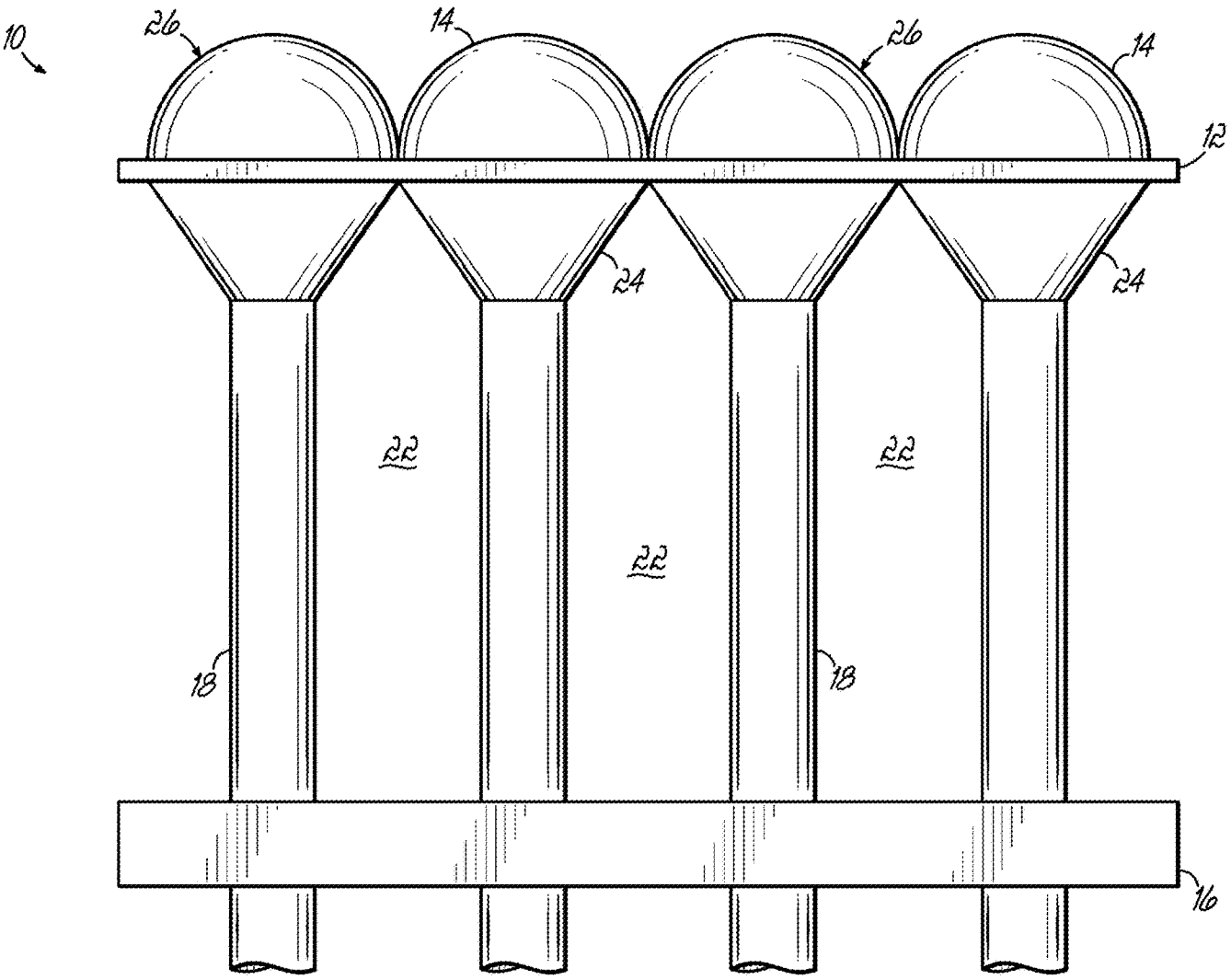
FIG. 3 is a side view of the drainage management apparatus of FIG. 1, with the side panels removed for illustrative purposes.
Figure 4:
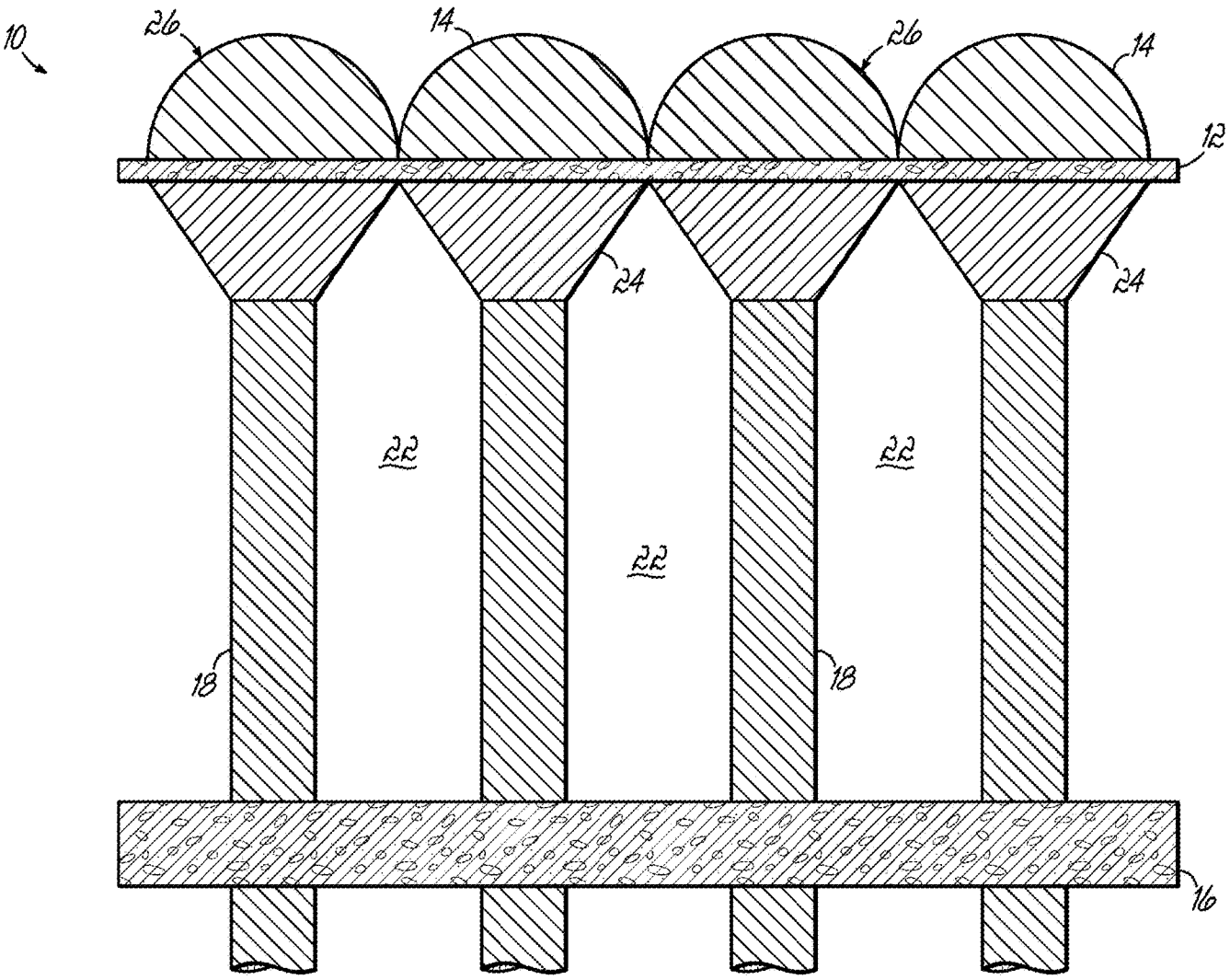
FIG. 4 is a cross-sectional view of the drainage management apparatus of FIG. 1.

Referring now to FIGS. 2-4, the Figures show alternative views of a depicted embodiment of a drainage management apparatus 10. In an embodiment, the upper slab 12 and the lower slab 16 may each have approximate dimensions of 2 ft (0.61 m) by 4 ft (1.2 m). It is to be understood that the upper slab 12 and/or lower slab 16 can be alternatively dimensioned. With these dimensions, the upper slab 12 can be divided into 8, 1-square foot (144 $in^2$, 0.093 $m^2$) sections such that each of the 1-square foot sections can circumscribe one of the domes 14. In an embodiment, a diameter of a dome 14, d, is 12 in (0.305 m) and the circular area beneath the dome 14 is $\pi*d^2/4=113$ $in^2$ (0.073 $m^2$). It is to be understood that the domes 14 can be alternatively arranged on the upper slab 12 and, further, the domes 14 can be alternatively dimensioned.

Thus, for the above-described embodiment, the domes 14 theoretically will carry approximately 78% (113 $in^2$/144 $in^2$) of the load from the soil located on top of the drainage management apparatus 10 and the flat areas of the upper slab 12 (i.e., the areas between or beside the domes 14) will theoretically carry the remaining approximately 22% of the load of the soil. The load on the flat areas of the upper slab 12 between the raised domes 14 will be less than 22% of the load of the soil because the soil carries at least some of the vertical load due to the soil-structure interaction. It is to be understood that the division of the load between the domes 14 and the upper slab 12 will vary depending on the arrangement, dimensions, and other characteristics of the domes 14 and upper slab 12. For example, the dome 14 could carry at least approximately 50%, 60%, or 70% of the load from the soil located on top of the drainage management apparatus 10.

As shown best in FIGS. 3 and 4, a column 18 is placed under the center of each dome 14 to provide support for the dome 14 and the portion of the upper slab 12 surrounding the dome 14. In an embodiment, the column 18 may have a 12 in (0.305 m) diameter at or near a top of the column 18 (matching the diameter of the dome 14) that tapers to a 4-6 in (0.102-0.152 m) column 18 at an angle, a, over a distance below the top of the column 18 (e.g., the tapered cone portion 24). Together, a dome 14, column 18, and tapered cone portion 24 may be referred to as a vertical assembly 26. It is to be understood that the columns 18 can be alternatively dimensioned and arranged and, further, it is to be understood that the columns 18 may or may not be tapered. The vertical load is transferred from the domes 14 (and the portions of the upper slab 12 surrounding the domes 14) to the columns 18 located beneath the domes 14. Specifically, in this embodiment, the load is transferred to the tapered cone portion 24 of the columns 18.

Figure 4A:
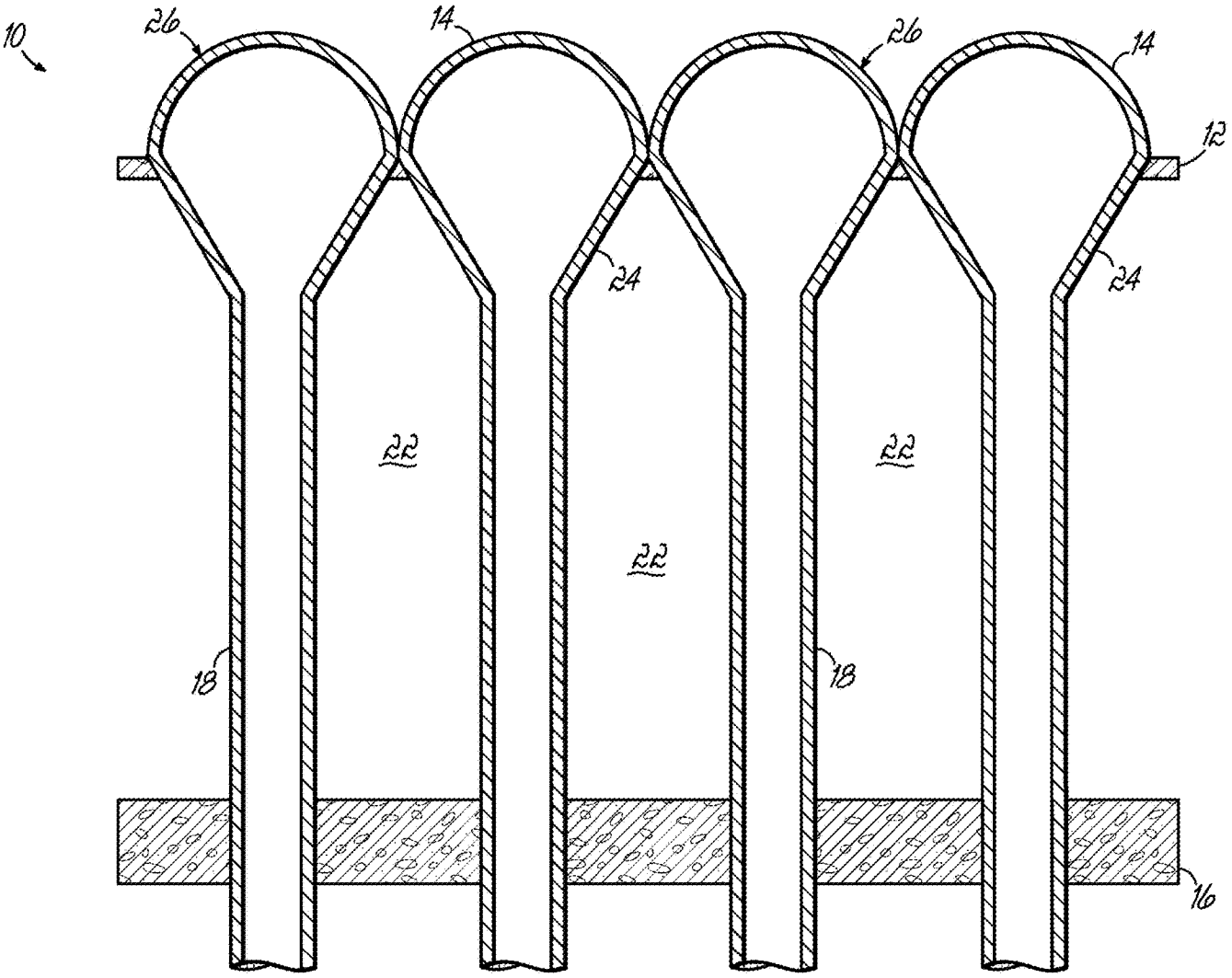
FIG. 4A is a cross-sectional view of an alternative embodiment of the drain management apparatus.

Referring now to FIGS. 4 and 4A, the Figures show cross-sectional views of embodiments of the drain management apparatus 10. In the embodiment depicted in FIG. 4, domes 14, columns 18, and tapered cone portions 24 are separate, solid pieces assembled to form vertical assemblies 26. In an alternative embodiment, a vertical assembly 26 may include a dome 14, column 18, and tapered cone portion 24 that are integrally formed as a single, solid assembly 26. In an alternative embodiment depicted in FIG. 4A, a vertical assembly 26 includes a dome 14, column 18, and tapered cone portion 24 that are integrally formed as a single, hollow assembly 26. It is to be understood that the domes 14, columns 18, and tapered cone portions 24 that make up the vertical assemblies 26 can be alternatively arranged and/or formed. For example, the dome 14 of a vertical assembly 26 could be a solid piece (e.g., as shown in FIG. 4) and integrally formed (e.g., single body construction) with a hollow tapered cone portion 24 and a hollow column 18 (e.g., as shown in FIG. 4A).

Referring generally to FIGS. 1-4A, the additions of domes 14 to the upper slab 12 to form a domed profile makes use of soil-structure interactions to enable the upper slab 12 (with domes 14) to withstand burial under a greater height of backfill in comparison to an upper slab 12 without domes 14 (i.e., without a domed profile). Generally, domes 14 are employed on the slab that is in contact with the soil—the upper slab 12. Other slabs of the drainage management apparatus 10 (e.g., the lower slab 16) may be flat and without domes 14. The slabs without domes 14 (e.g., the lower slab 16) provide lateral support to the columns 18 and support resistance to lateral pressure on the side panels 20. Using a dome-shape (e.g., domes 14) to take advantage of soil-structure interactions to reduce the load on surrounding areas (e.g., the upper slab 12) is applicable to a wide variety of underground systems supported by columns (or similar), not necessarily only those designed to hold stormwater.

While all of the invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the Applicants' general inventive concept.

What is claimed is:

1. A drainage management apparatus for collecting and storing stormwater for controlled discharge, the drainage management apparatus comprising:

an upper slab and a lower slab, the upper slab spaced a distance from the lower slab;

at least one vertical assembly, the at least one vertical assembly comprising:

a column located between the upper slab and the lower slab and spanning the distance separating the upper slab and the lower slab; and a dome located atop the column such that the dome is supported by the column, the dome protruding from the upper slab and configured to carry a load; and a plurality of side panels, the plurality of side panels surrounding the upper slab, the lower slab, and the at least one vertical assembly to form a chamber, the chamber configured to store stormwater.

2. The drain management apparatus of claim 1, wherein the column comprises a tapered cone portion, the tapered cone portion tapering at an angle between a first diameter and a second diameter, the first diameter and the second diameter located at opposing ends of the tapered cone portion.

3. The drain management apparatus of claim 2, wherein the first diameter of the tapered cone portion is approximately equivalent to a diameter of the dome, and wherein the second diameter of the tapered cone portion is less than a diameter of the dome.

4. The drain management apparatus of claim 3, wherein the tapered cone portion is arranged such that the first diameter of the tapered cone portion is located adjacent to the dome.

5. The drain management apparatus of claim 1, wherein the column and the dome of the at least one vertical assembly are of hollow construction.

6. The drain management apparatus of claim 1, wherein the column and the dome of the at least one vertical assembly are of solid construction.

7. The drain management apparatus of claim 1, wherein the column and the dome of the at least one vertical assembly are of integral construction.

8. The drain management apparatus of claim 1, wherein the at least one vertical assembly comprises a plurality of vertical assemblies and the plurality of vertical assemblies are arranged in a grid-like pattern relative to the upper slab and the lower slab.

9. The drain management apparatus of claim 1, wherein the lower slab provides lateral support to the column and provides resistance to lateral pressure on the plurality of side panels.

10. The drain management apparatus of claim 1, wherein the dome is configured to utilize soil-structure interactions to reduce the load on the upper slab from a soil located on top of the drain management apparatus.

11. The drain management apparatus of claim 1, wherein the dome carries at least 50% of the load from a soil located on top of the drain management apparatus.

12. The drainage management apparatus of claim 11, wherein the dome carries at least 60% of the load from the soil located on top of the drain management apparatus.

13. The drainage management apparatus of claim 12, wherein the dome carries at least 70% of the load from the soil located on top of the drain management apparatus.

14. The drain management apparatus of claim 1, wherein the load is transferred from the dome to the column.

15. The drain management apparatus of claim 1, wherein the chamber is wrapped in a cover.

16. The drain management apparatus of claim 15, wherein the cover is a nonwoven geotextile fabric.

17. The drain management apparatus of claim 1, wherein the chamber comprises at least one inlet pipe and at least one outlet pipe.

18. The drain management apparatus of claim 1, wherein the drain management apparatus is made of thermoplastic materials.

19. The drain management apparatus of claim 18, wherein the thermoplastic materials are selected from the group consisting of polyvinyl chloride (PVC) and polyethylene (PE).

20. A drainage management system for collecting and storing stormwater for controlled discharge, the drainage management system comprising:

a plurality of drainage management apparatuses, each drainage management apparatus of the plurality of drainage management apparatuses according to claim 1, wherein the plurality of drainage management apparatuses are arranged to cover a desired area.

* * * * *